US005496990A

United States Patent [19]

Gillieron

[11] Patent Number: 5,496,990

[45] Date of Patent: Mar. 5, 1996

[54] VERSATILE LOCKING MECHANISM FOR POSTAGE METERS

[76] Inventor: Christian Gillieron, Solothurnstrasse 7, Fraubrunnen, Switzerland, CH-3312

[21] Appl. No.: 159,850

[22] Filed: Dec. 1, 1993

[51] Int. Cl.[6] ..... G07G 1/00

[52] U.S. Cl. ..... 235/101; 235/130 R

[58] Field of Search ..... 235/101, 130 R; 101/91

[56] References Cited

U.S. PATENT DOCUMENTS

| | | | |
|---|---|---|---|
| Re. 31,875 | 4/1985 | Check, Jr. et al. | 364/900 |
| 3,938,095 | 2/1976 | Check, Jr. et al. | 340/172.5 |
| 3,978,457 | 8/1976 | Check, Jr. et al. | 340/172.5 |
| 4,180,856 | 12/1979 | Check, Jr. et al. | 364/466 |
| 4,202,489 | 5/1980 | Schubert | 235/101 |
| 4,246,643 | 1/1981 | Hubbard | 364/900 |
| 4,271,481 | 6/1981 | Check, Jr. et al. | 364/900 |
| 4,340,809 | 6/1982 | Betcher | 235/101 |
| 4,484,307 | 11/1984 | Quatse et al. | 364/900 |
| 4,507,744 | 3/1985 | McFiggans et al. | 364/700 |
| 4,509,780 | 4/1985 | Erwin | 292/307 R |
| 4,636,975 | 11/1987 | Soderberg et al. | 364/900 |
| 4,650,973 | 3/1987 | Pike | 235/1 D |
| 4,675,841 | 6/1987 | Check, Jr. et al. | 364/900 |
| 4,985,613 | 1/1991 | Lytra et al. | 235/101 |
| 5,093,560 | 3/1992 | Abellana | 235/101 |

*Primary Examiner*—Patrick J. Stanzione
*Attorney, Agent, or Firm*—Brumbaugh, Graves, Donohue & Raymond

[57] ABSTRACT

A postal-lock mechanism for preventing unauthorized recharging of a postage meter and identifying tampering of a postage meter is disclosed. It contains a cylinder-like assembly mounted in the postage meter housing. The postage meter is "locked," i.e. made inaccessible for adding postage, when the postal-lock is in a predetermined angular position. To add postage to the meter, the postal-lock is rotated to activate a limit switch in the meter, subsequent to which action additional postage may be added, for example via keyboard. The postal-lock mechanism also locks the meter housing to the meter chassis, obviating the need for a separate locking mechanism. The postal-lock mechanism may be used in conjunction with a wire and lead seal, a frangible membrane, a wire and lead seal and a frangible membrane, a key lock, or a key lock and a wire and lead seal.

23 Claims, 13 Drawing Sheets

VERSATILE LOCKING MECHANISM FOR POSTAGE METERS

BACKGROUND OF THE INVENTION

This invention relates to a tamper-proof locking mechanism to be used in connection with access openings of electrical or mechanical device housings. In particular, this invention relates to a versatile, tamper-proof locking mechanism for preventing unauthorized recharging of postage meters.

Postage meters are used by businesses in many countries to dispense postage in lieu of physically purchasing and applying postage stamps. Postage meters are usually attached to a separate postage meter base which has a feed mechanism that feeds letters between the printhead of the postage meter and the meter base. Mechanical postage meters account for the amount of postage remaining in the meter by means of a mechanical descending register. Electronic postage meters account for the remaining postage amount by means of microprocessors and registers stored in memory. Both mechanical and electronic postage meters print the postage value either on a label which is subsequently attached to an envelope, or directly on the envelope. When the postage value remaining in the postage meter is less than a predetermined value, the meter will cease to print. When the available postage is low, then, the postage meter can be returned to the post office, and a post office employee can add a desired postage amount to "reset" meter.

In order to prevent unauthorized access to the interior of the postage meter housing, many countries require the postage meters to be equipped with security locks or sealing mechanisms. Several types of postal-locks or seals have been devised, but none has been universally adopted. In the United States, the access mechanism of the postage meters is usually sealed with a wire and lead seal after a desired mount of postage has been added to the meter. The wire must be cut before one can access the interior of the postage meter housing, or activate a switch that allows one to add postage to the meter. For convenience, this wire and lead seal combination is often referred to herein only as a "lead seal." Other types of postal-lock mechanisms for postage meters utilized in various countries include a tamper-indicating frangible membrane in the form of a paper seal that must be broken to reset the meter, a key lock, a combination of a paper seal and a lead seal, and a combination of a key lock and a lead seal.

Because the required postage meter security mechanisms differ from one country to the next, postage meter manufacturers have had to produce multiple versions of a postage meter, each version having the appropriate postal-lock mechanism for a designated country. Accordingly, many parts of a postage meter are not interchangeable among different versions of the meter. As a result, the price of a postage meter and the repair costs are increased due to the increased number of required parts to be manufactured and kept in inventory.

Conventional postage meters are usually constructed such that the meter housing is secured to the meter chassis by means of a locking mechanism separate from the postal-lock mechanism. This type of construction has resulted in three problems: a) one cannot readily ascertain whether the meter housing is securely attached to the meter chassis without carefully examining the entire meter assembly; b) the number of required parts for the meter is increased; and c) once a meter component is replaced, the entire meter assembly must be realigned so that all of the component parts are in correct relationship to one another.

There is thus a need for a versatile postal-lock mechanism that can readily satisfy the existing postage meter security requirements of various countries and simplify the overall construction of the postage meter by means of combining the postal-lock mechanism with the locking mechanism securing the meter housing to the meter chassis.

SUMMARY OF THE INVENTION

In keeping with the invention, a versatile access-security or postal-lock mechanism for postage meters is disclosed. The disclosed invention has particular utility in readily satisfying the existing postage meter security requirements of various countries by being adapted to be used in conjunction with any combination of a lead seal, a frangible membrane, and/or a key lock. The disclosed invention has the additional advantage of simplifying the overall construction of postage meters by combining the postal-lock mechanism with the locking mechanism securing the meter housing to the meter chassis.

The present invention provides a novel, versatile postal-lock mechanism comprising a cylinder-like assembly adapted to be mounted in the postage meter housing. In each preferred embodiments of the present invention, the postage meter is locked, i.e., not accessible for adding additional postage, by rotating the postal-lock assembly to a predetermined angular position in relation to the postage meter housing. One end of the cylinder-like, postal-lock assembly is a disc-shaped cover forming a portion of the postage meter housing once the assembly is mounted in the meter housing. The disc-shaped cover has a central opening and an elongated slot extending generally radially inwardly from the periphery of the cover. Below the cover, a sliding plate is slidably connected to the cover such that the sliding plate has a range of movement along the flat plane of the disc-shaped cover. Directly below the sliding plate, the cylinder-like assembly has at its radial periphery a slot for receiving a frangible membrane. The frangible membrane is usually a paper, but other material may be used. To turn the postal-lock to a position permitting resetting, one must break the frangible membrane by introducing a probe through the central opening, pushing down on an interior surface.

One embodiment of the present invention utilizes the lead seal to prevent access through the central opening. The lead seal secures the sliding plate in a locked position in which the central opening of the disc-shaped cover is covered by the sliding plate. The frangible membrane may also be positioned directly below the slidable bolt.

For the preferred embodiment adapted to be used in conjunction with the frangible membrane and the lead seal, accessing the postage meter to add postage requires the following steps: a) break the lead seal; b) slide the bolt away from the central opening of the disc-shaped cover; c) break the frangible membrane; and d) rotate the cylinder-like assembly to a predetermined position. The broken membrane is removed, and once the desired amount of postage has been added, a new frangible membrane is inserted into the postal-lock assembly. The postal-lock assembly is rotated back to the initial position. Finally, the lead seal securing the slidable bolt is replaced.

Another preferred embodiment of the present invention utilizes the lead seal and a key lock. In this embodiment, the key lock is provided in the central portion of the cylinder-like, postal-lock assembly, directly below the central opening of the disc-shaped cover. In order to access the postage meter to add postage, the following steps must be taken: a) break the lead seal; b) slide the bolt away from the central opening; c) open the key lock provided in the central portion of the postal-lock assembly with a key; and (d) turn the key to a predetermined position.

In all of the contemplated embodiments of the present invention, locking of the postage meter housing to the meter chassis is accomplished by engaging a portion of the postal-lock assembly below the disk-shaped cover with the postage meter chassis-connected part by rotating the postal-lock assembly relative to the meter housing and the chassis. The interengaging parts of the lock and the chassis-connected part block removal of the meter housing from the chassis. To open the meter the postal-lock is rotated to a third position where the interengaging parts are free of one another.

It is an object of this invention to provide an access-security mechanism for postage meters that can readily indicate signs of unauthorized access or attempted access to the interior of the postage meter.

It is another object of this invention to provide a versatile postal-lock mechanism for postage meters that can simultaneously satisfy the different postage meter security requirements of various countries.

It is another object of this invention to provide a versatile postal-lock mechanism for postage meters that can simplify the overall construction of postage meters by integrating the locking mechanism securing the meter housing to the meter chassis as part of the postal-lock mechanism.

It is yet another object of this invention to provide a versatile postal-lock mechanism for postage meters that can simultaneously satisfy the existing postage meter security requirements of various countries and simplify the overall construction of postage meters by integrating the locking mechanism securing the meter housing to the meter chassis as a part of the postal-lock mechanism.

DETAILED DESCRIPTION OF THE INVENTION

Figure 1A:
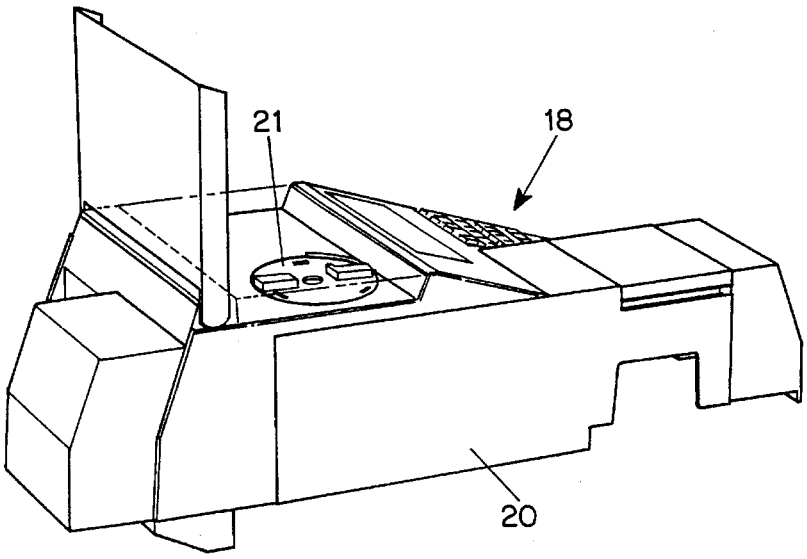
FIG. 1A is a perspective view of a postage meter having a postal-lock mechanism of the present invention.
Figure 1B:
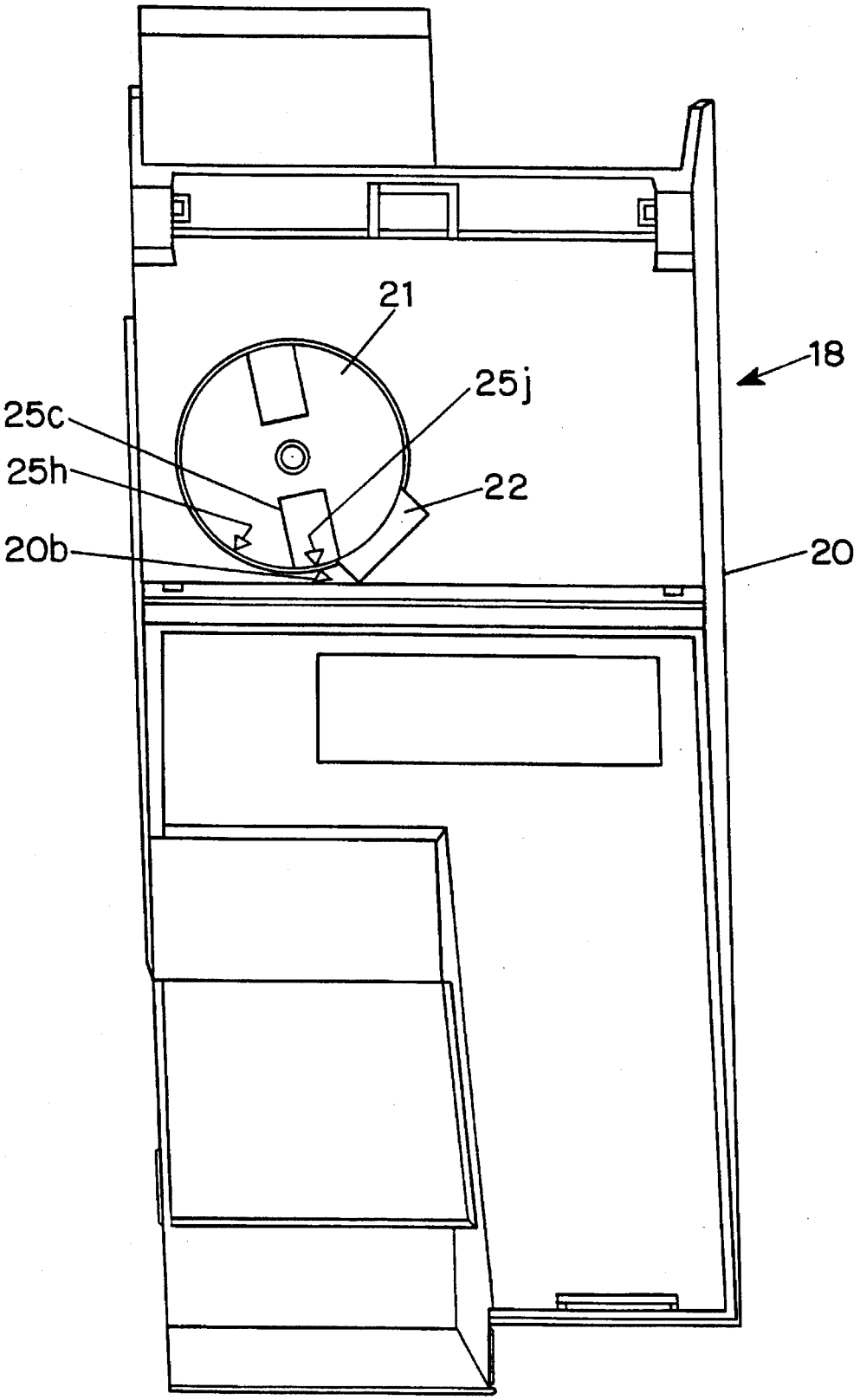
FIG. 1B is a top plan view of the postage meter of FIG. 1A showing an access opening in the postage meter housing for inserting a frangible membrane into the postal-lock mechanism.

In FIGS. 1A and 1B an electronic postage meter 18 has a postal-lock mechanism 21 of the present invention is mounted in the postage meter. The postal-lock mechanism or postal-lock is rotatable from a first angular position, shown in FIGS. 2A and 2B, to a second angular position, shown in FIG. 2C, and to a third angular position shown in FIG. 2D. In its first angular position, the lock prevents resetting by which additional postage can be set in to the meter's descending register. In its first position it also locks the meter housing to its chassis. In its second angular position the lock permits resetting, but continues to lock the housing to the chassis. In its third angular position the lock releases the meter housing from the chassis, permitting opening of the meter for repair, etc.

Figure 3:
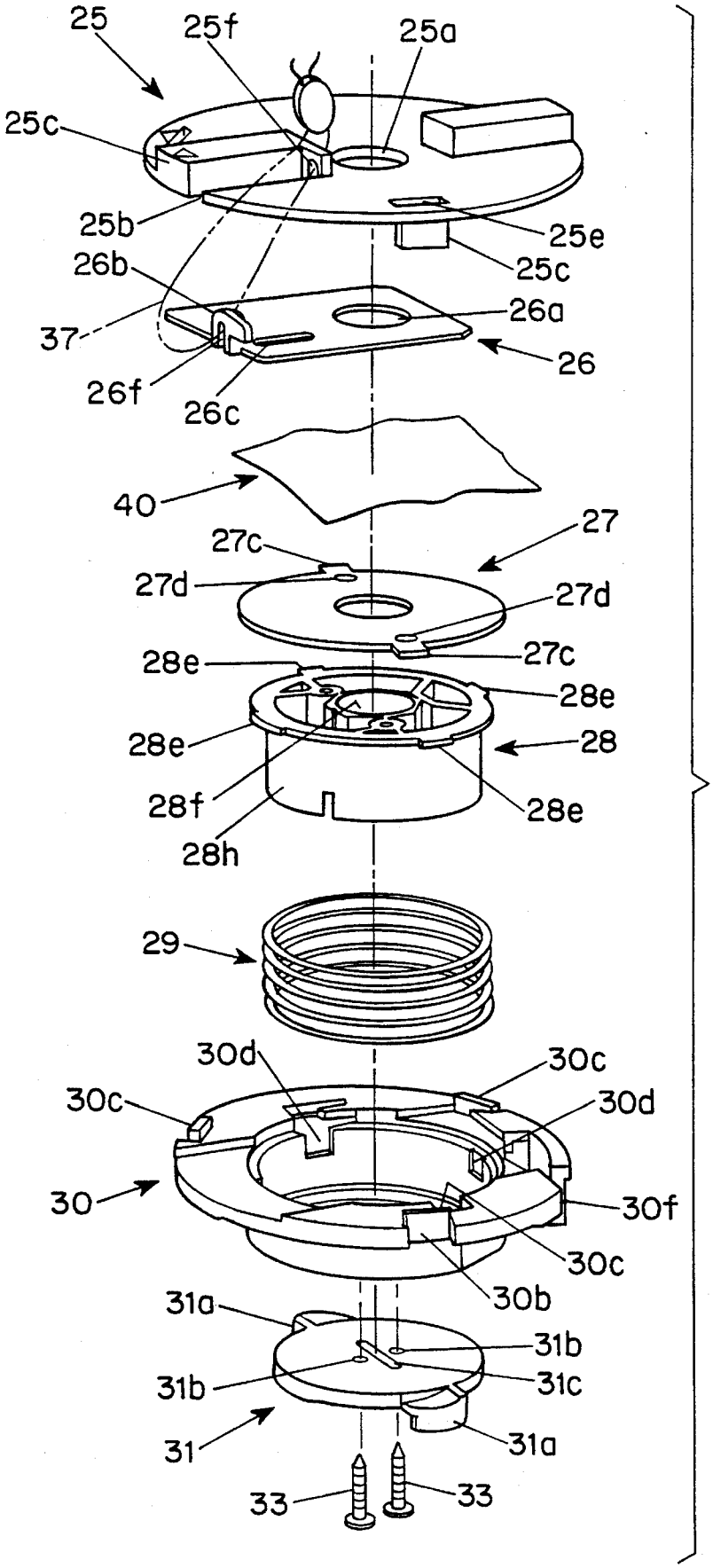
FIG. 3 is an exploded view of the cylinder-like postal-lock mechanism according to one embodiment of the present invention.
Figure 4A:
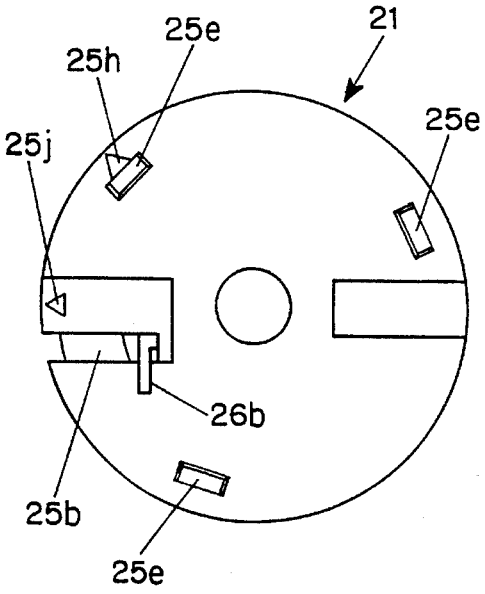
FIG. 4A is a top plan view of the cylinder-like postal-lock mechanism of the present invention.
Figure 4B:
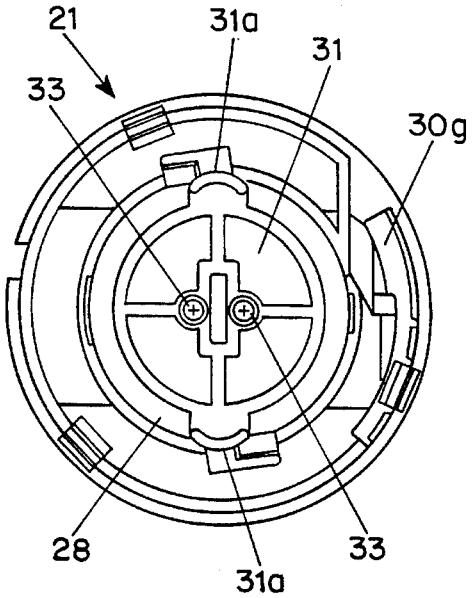
FIG. 4B is a bottom plan view of the cylinder-like postal-lock mechanism of the present invention.
Figure 4C:
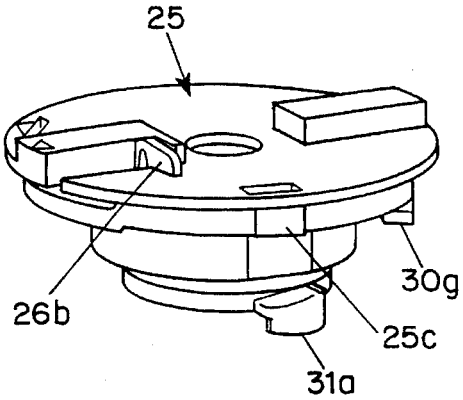
FIG. 4C is a first perspective view of the cylinder-like, postal-lock mechanism of the present invention from above the plane of the upper surface.
Figure 4D:
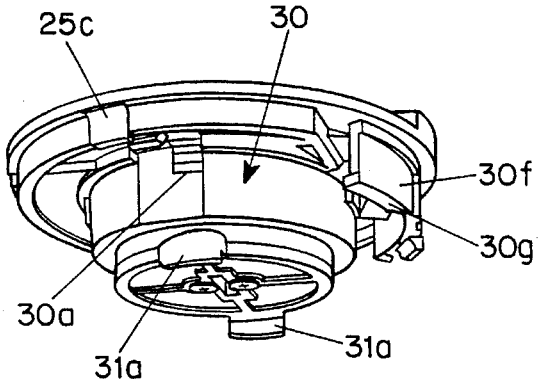
FIG. 4D is a second perspective view of the cylinder-like, postal-lock mechanism of the present invention from below the plane of the lowermost surface.
Figure 8A:
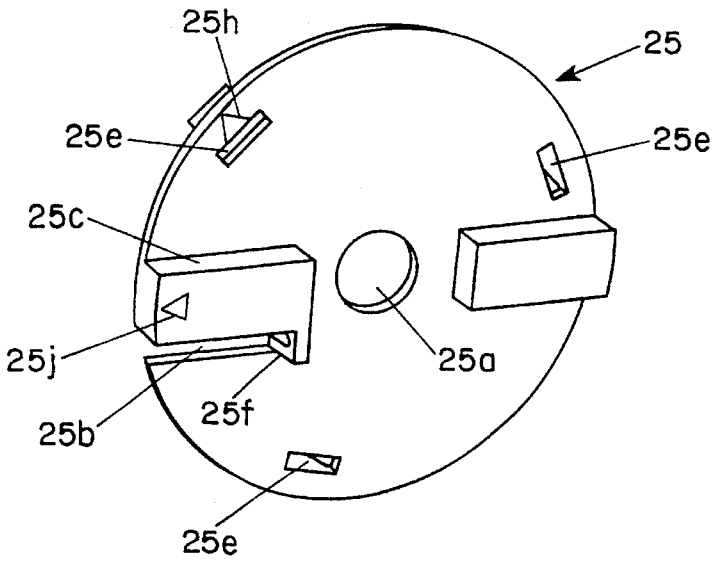
FIG. 8A and 8B are perspective views of the disc-shaped cover of the postal-lock mechanism, showing, respectively, the top and bottom of the disc-shaped cover.
Figure 8B:
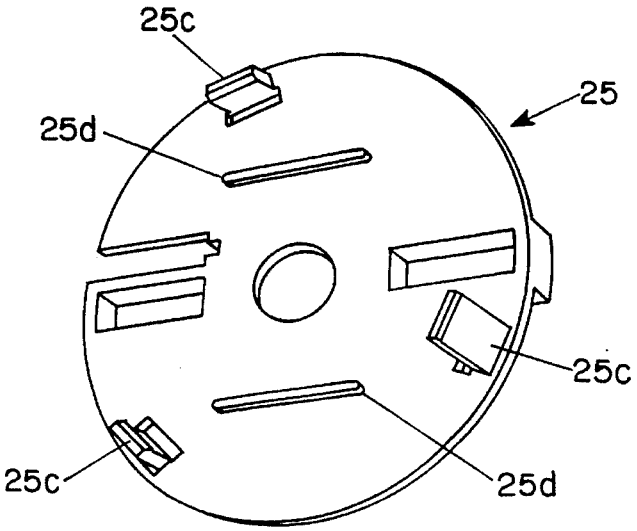
Figure 9A:
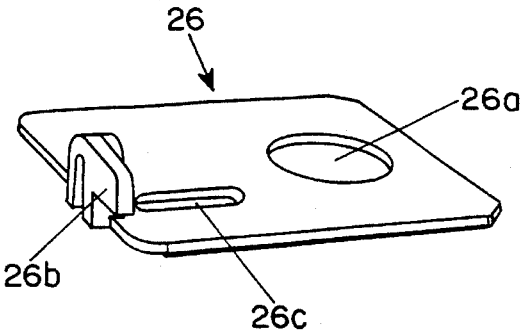
FIG. 9A and 9B are perspective views of the sliding plate of the postal-lock mechanism showing, respectively, the top and bottom of the sliding plate.
Figure 9B:
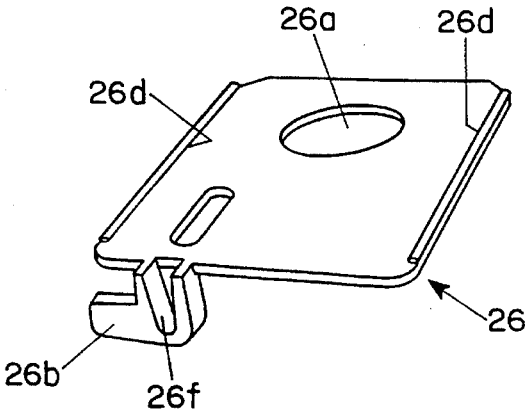

According to one embodiment of the present invention shown in FIG. 3, the postal-lock-mechanism 21 is adapted for use with a lead seal 37 and a frangible membrane 40. A disc-shaped cover 25, also shown in isolation in FIGS. 8A and 8B, is an external member of the postal-lock mechanism provided at the top of the postal-lock mechanism. The cover 25 has a central opening 25*a* and an elongated slot 25*b* extending generally radially inwardly from the periphery of the disc-shaped cover adjacent to an upwardly projecting rectangular lug 25*c*. The cover 25 has an arched projection 25*f*, extending perpendicular to the flat plane of the cover at the radial inward end of the slot 25*b*. Immediately below the cover 25, there is a sliding plate 26, also shown in isolation in FIGS. 9A and 9B. The sliding plate 26 has at one end a second arched projection 26*b* projecting upwardly from the flat top plane of the sliding plate. The second arched projection 26*b* has an opening 26*f*, shown best in FIGS. 9A and 9B, and this second arched projection is received in the elongated slot 25*b* in the cover 25. As shown in FIG. 8B, the cover 25 has two parallel tracks 25*d* on its bottom surface that guide the sliding movement of the sliding plate 26 beneath the cover 25. The sliding plate 26 also has a central circular opening 26*a* and an elongated opening 26*c*. When the sliding plate 26 is positioned such that the second arched projection 26*b* is juxtaposed with the first arched projection 25*f* of the disk-shaped cover 25, the sliding plate 26 seals the central opening 25*a* of the cover 25. When the sliding plate 26 is moved such that the second arched projection 26*b* is positioned at the radial edge of the cover 25, the elongated opening 26*c* of the sliding plate 26 overlaps the elongated slot 25*b* of the cover 25, and the circular opening 26*a* coaxially aligns with the central opening 25*a* of the cover 25, thereby unsealing the central opening 25*a*.

Figure 10A:
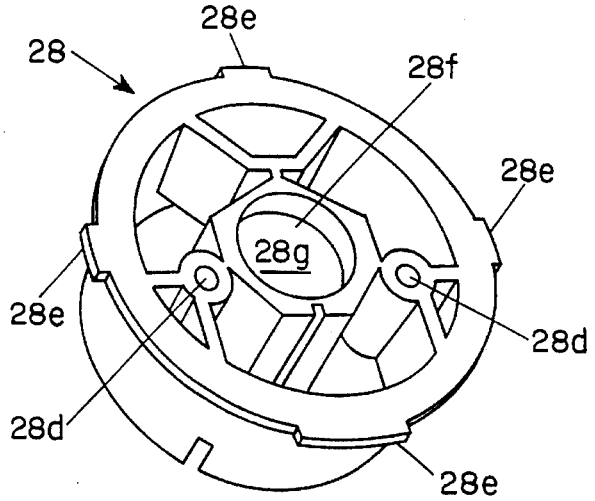
FIG. 10A and 10B are perspective views of an inner lock body of the postal-lock mechanism according to the embodiment of the present invention shown in FIG. 3, showing, respectively, the top and bottom of the inner lock body.
Figure 10B:
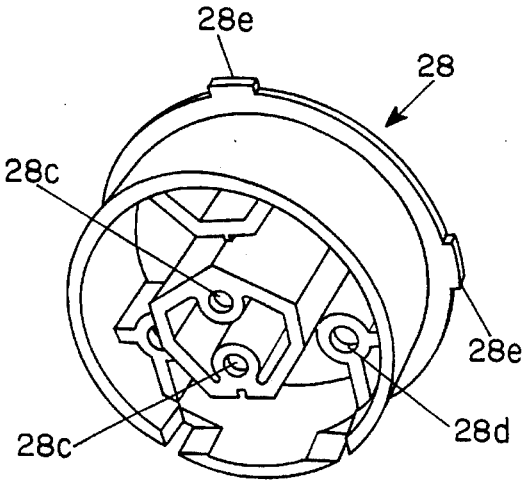

In the embodiment of the postal-lock mechanism illustrated in FIG. 3, a membrane support plate 27 is positioned below the sliding plate 26. The membrane support plate 27 has a central opening 27*a*, two peripheral openings 27*b*, and two protrusions 27*c*. The central opening 27*a* coaxially aligns with the central opening 25*a* of the disk-shaped cover 25. An inner lock body 28, also shown in isolation in FIGS. 10A and 10B, is positioned below the membrane support plate 27. The inner lock body or member 28 has a central chamber 28*f*. An outer cylindrical surface 2 of the inner lock body 28 is coaxially surrounded by a compression spring 29. An outer lock body or member 30, also shown in isolation in FIGS. 11A and 11B, in turn coaxially surrounds the inner lock body 28 and the compression spring 29. Finally, a base plate 31, shown in isolation in FIGS. 12A and 12B, and having a central slot 31c, is positioned at the bottom of the outer lock body 30.

Figure 11A:
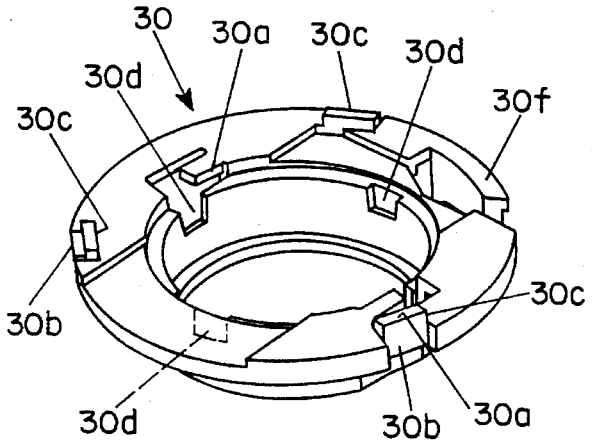
FIG. 11A and 11B are perspective views of an outer lock body of the postal-lock mechanism of the present invention, showing, respectively, the top and bottom of the outer lock body.

The postal-lock mechanism 21, shown assembled in FIGS. 4A–4D, is held together as a unit by securing the disk-shaped cover 25 to the outer lock body 30 by means of clamp arms 25*c*, and securing the base plate 31 to the inner lock body 28 by means of a pair of screws 33. The screws 33 pass through a pair of apertures 31*b* of the base plate 31 and are threaded into a pair of hole 28*c* (FIG. 10B) in the inner lock body 28. The membrane support plate 27 is secured to the outer lock body 30 by inserting the protrusions 27*c* into a pair of slots 30*a* best seen in FIGS. 11A and 11B. Below the membrane support plate 27, the inner lock body 28 is nested within the outer lock body 30. Four protrusions 28*e* are slid into four receiving apertures 30*d* in the outer lock body 30, as best seen in FIG. 11A. The inner lock body 28 and the base plate 31, which are connected together, have a limited range of axial movement relative to the outer lock body 30 against the action of the compression spring 29 contained in the outer lock body 30. With its tabs in slots 30*a*, the plate 27 retains the inner lock body against the bias of the partially compressed resilient helical spring. Finally, the cover 25 is secured to the outer lock body 30 by the simultaneous clamping actions of the clamp arms 25*c*, shown best in FIG. 8B, which are snapped into position at respective clamp recesses 30*b*, shown best in FIG. 11B, and by the interlocking arrangement of three protrusions 30*c* with the respective receiving slots 25*e*, shown best in FIG. 8A.

Figure 5:
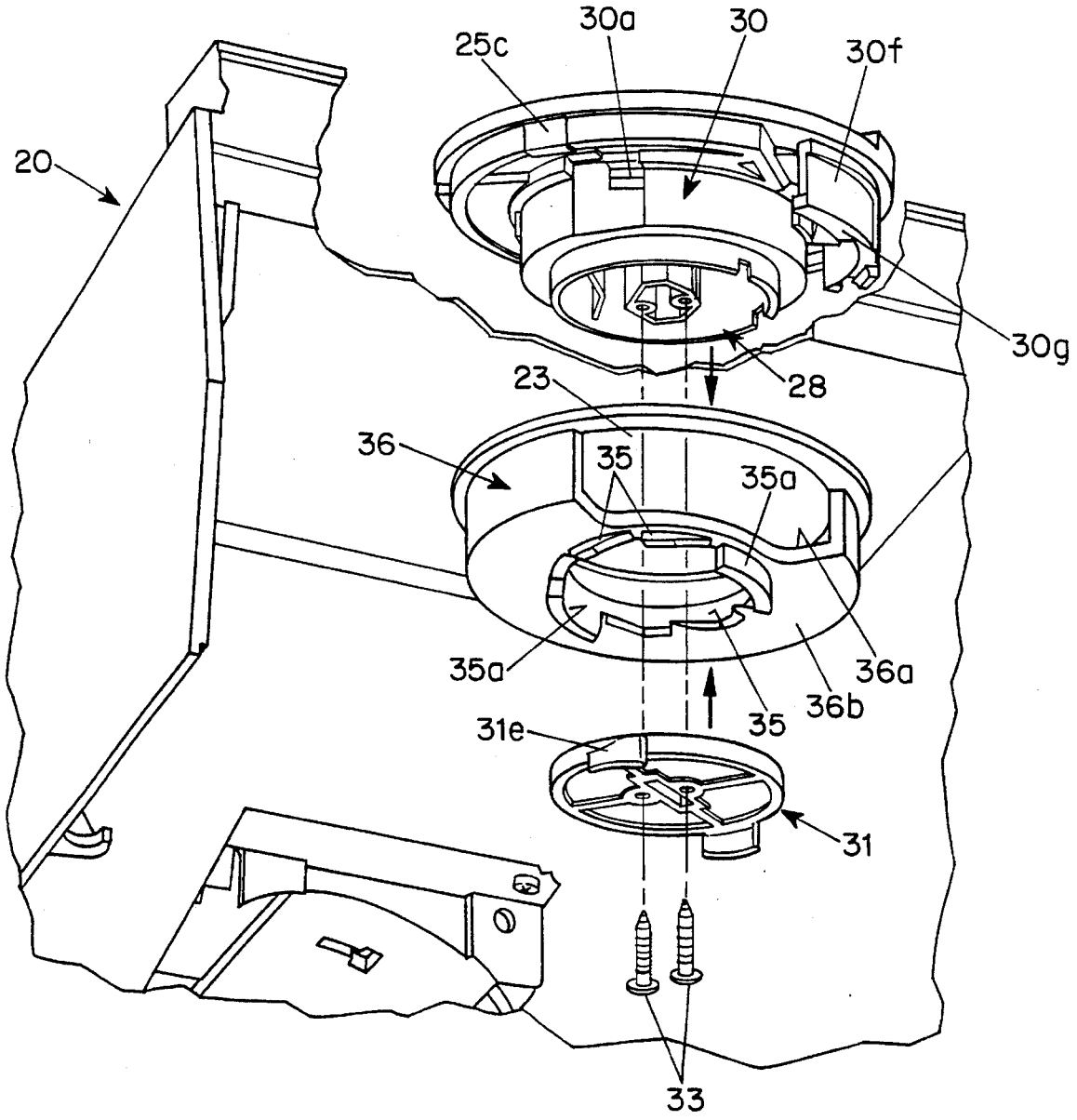
FIG. 5 is a fragmentary view, partly exploded, of the interior of the postage meter housing at the location of the postal-lock mechanism of the present invention.
Figure 6A:
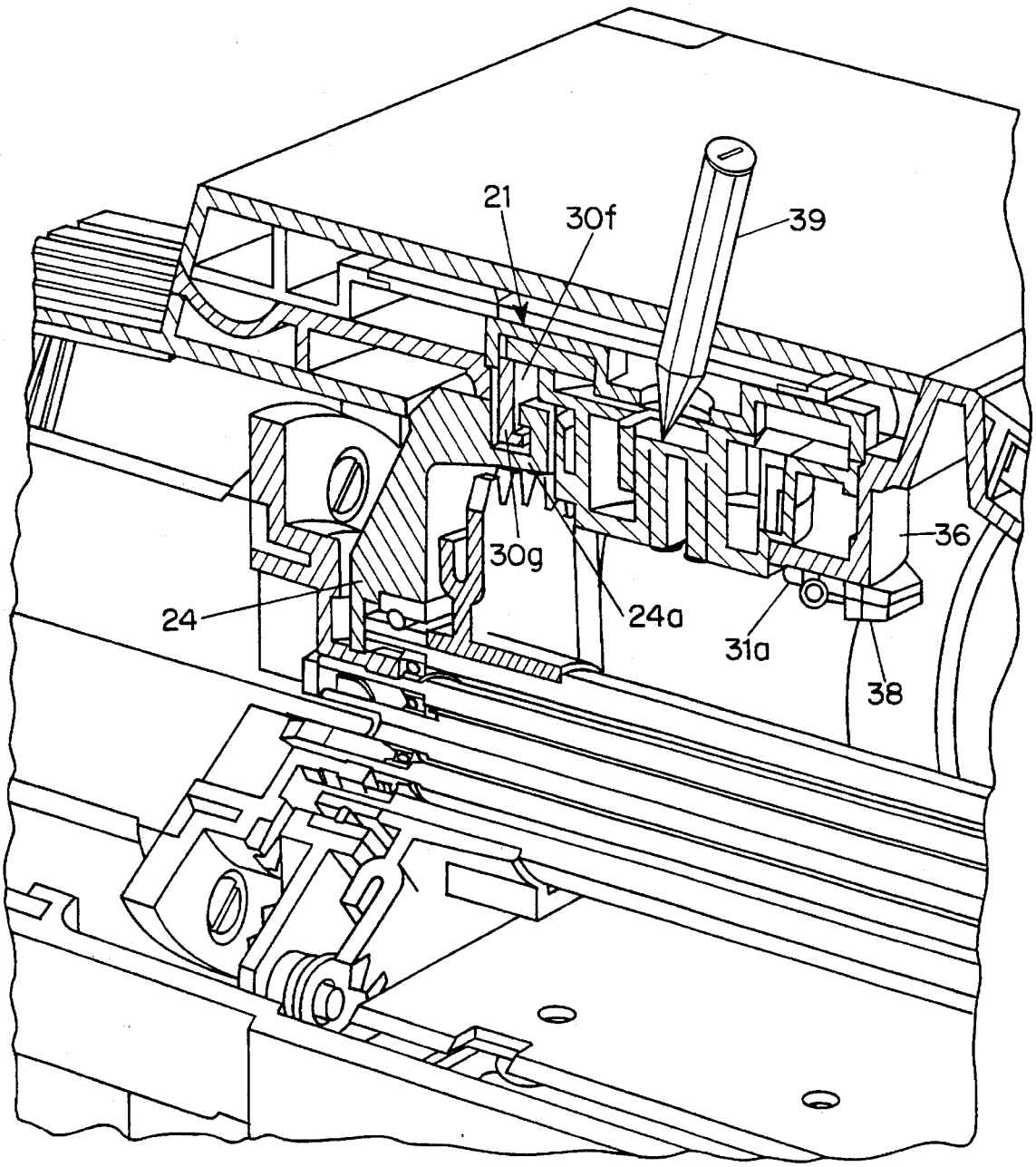
FIG. 6A is a fragmentary view partly in section of the postage meter housing showing the engagement of the postal-lock mechanism with the postage meter housing and the chassis.
Figure 6B:
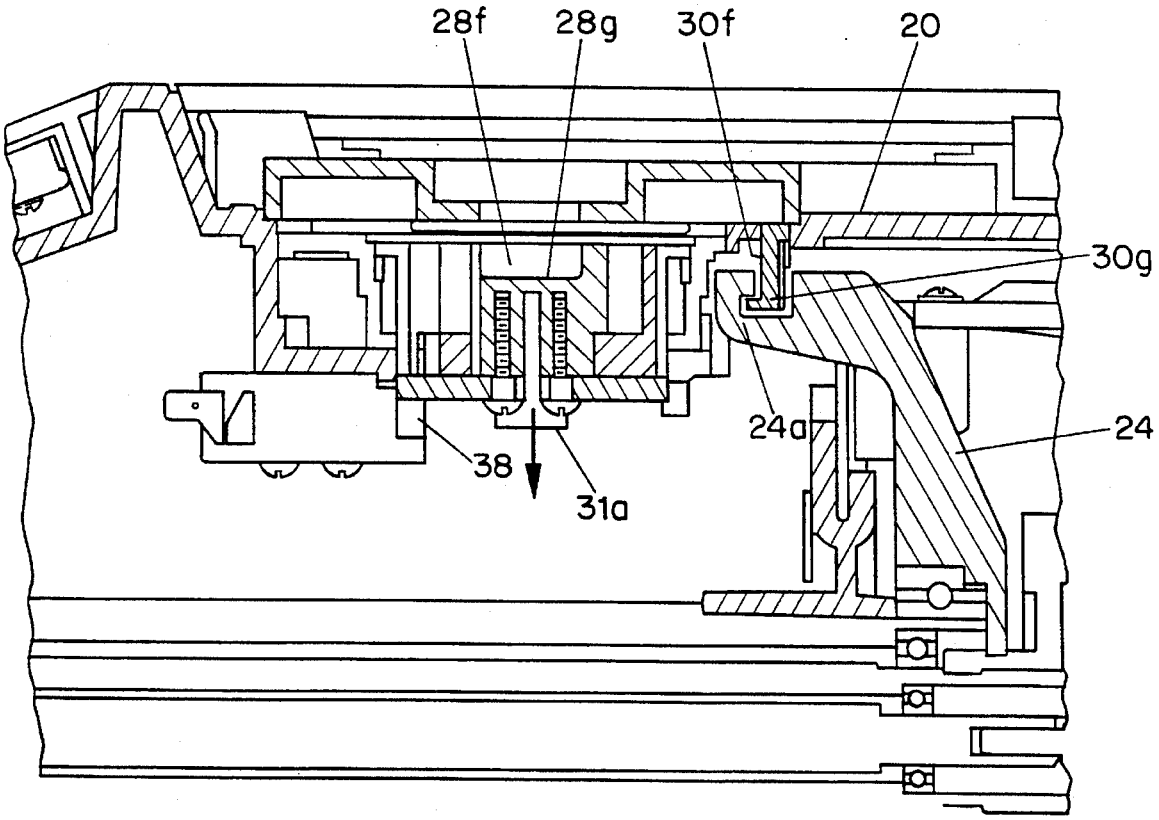
FIG. 6B is a fragmentary sectional view of the postage meter housing showing the vertical movement of selected postal-lock components during the unlocking sequence.

As shown in FIG. 5, from within the housing meter 20, the postal-lock mechanism 21 is mounted in a cup-shaped receptacle 36 of the meter housing 20. The receptacle 36 has an interior aperture 23 through a portion of its bottom surface and sidewall. It is at this aperture that a portion 30*f* of the outer lock body 30 is located. As shown in FIGS. 6A and 6B, a portion 24*a* of the postage meter chassis extends into the aperture 23. This portion 24*a* of the chassis is formed on a projecting region or part 24 that is connected to the chassis integrally or by some appropriate connectors. Turned to its first or second position shown in FIGS. 2A and 2C, the postal-lock mechanism locks the meter housing to the chassis as described below.

Figure 6C:
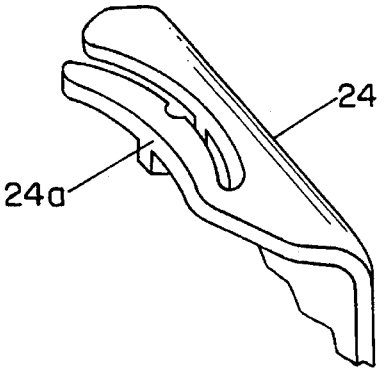
FIG. 6C is a fragmentary perspective view of a portion of postage meter chassis that cooperates with the postal-lock to lock the housing to the chassis.

Still referring to FIG. 5, when mounting the postal-lock mechanism of the embodiment shown in FIG. 3 in the housing 20, the base plate 31 is placed at a predetermined angular position at a bottom surface 36*b* of the cup-shaped receptacle 36 in the housing 20, and the base plate 31 is secured via screws 33 to the inner lock body 28, which is placed at the upper surface 36*a* of the bottom of the cup-shaped receptacle 36. In this way, the lock mechanism 21 is secured to the housing 20 from within. With the postal-lock mechanism turned to its third, unlocked position (FIG. 2D), the housing 20 is brought in to position, the chassis projection 224 extends into the cup shaped receptacle 36, and the postal-lock mechanism is turned toward its second position (FIG. 2C) to engage the portion 24 of the chassis. A radially inwardly directed projection 30*g* (FIGS. 5, 6A and 6B) is captured beneath the portion 24*a* of the chassis part 24. Shown in detail in FIG. 6C, the chassis has an arcuate slot defining the projection 24*a*. Preferably, the housing and mounted postal-lock is slid into position before the cover plate 25 is turned to move the outerlock body portion 30*f* into the slot.

A pair of radially outwardly projecting cams 31*a* of the base plate 31 extend outward beyond the periphery of the central opening in the bottom of the receptacle 36 preventing removal upwardly of the locking mechanism. As seen in FIG. 5, the upper cam surfaces 31*e* of the cams engage ratchet-like projections 35 located on, and extending perpendicular to, the bottom surface 36*b* of the cup-shaped receptacle 36 of the housing 20. The base plate 31 with its cam protrusions 31*a* is thus the internal member that engages a stationary part of the meter, the receptacle 36, to lock the postal-lock mechanism against rotation.

FUNCTIONAL DESCRIPTION OF FIG. 3 EMBODIMENT

Figure 7:
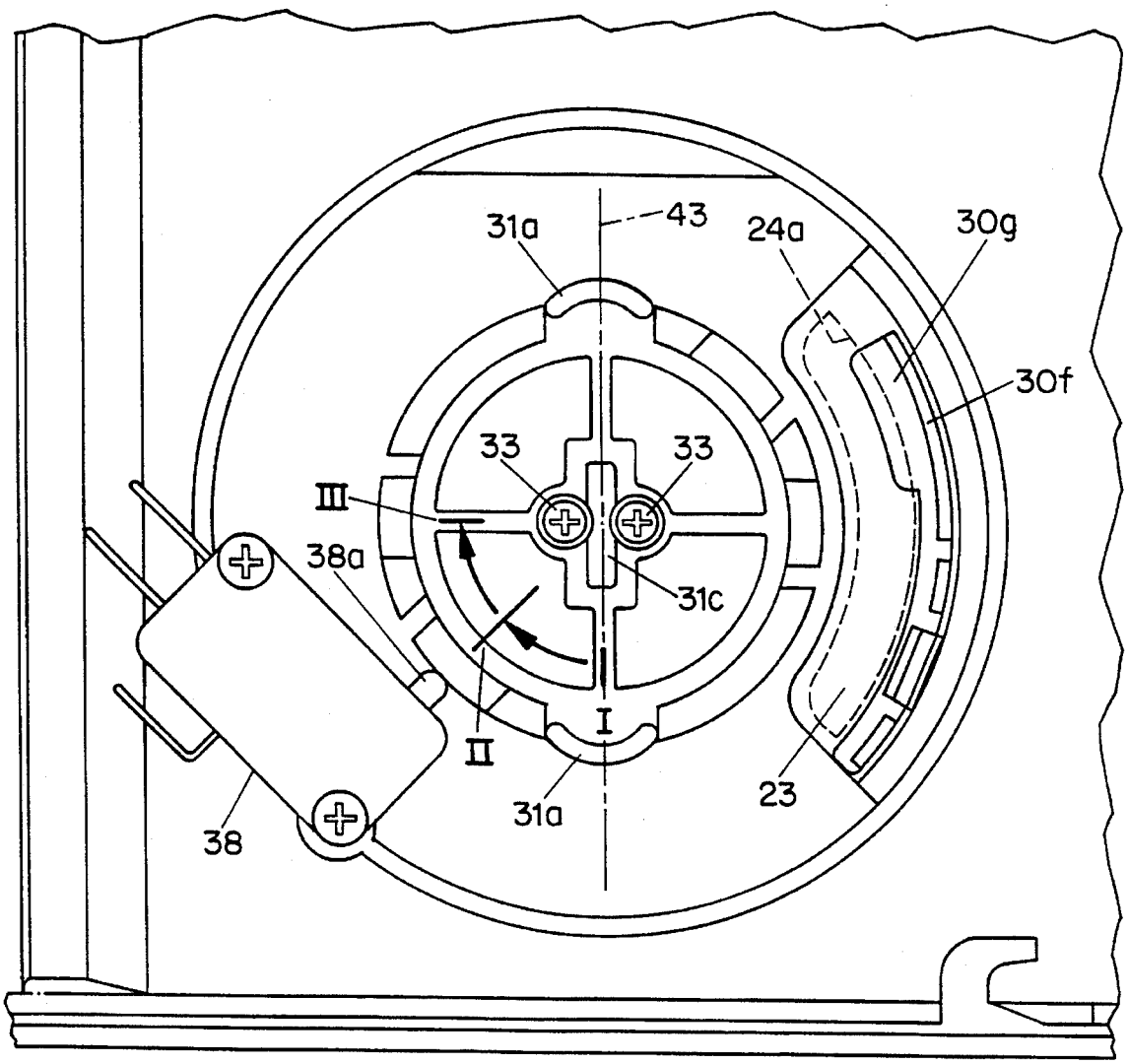
FIG. 7, a fragmentary bottom view of the postal-lock mechanism according to the embodiment of the present invention shown in FIG. 3, shows the relative angular movement of the entire postal-lock mechanism as well as the movement of its selected component parts.

The embodiment of the postal-lock mechanism of the present invention shown in FIG. 3, which is adapted to be used preferably with a lead seal 37 and a frangible membrane 40, is mounted in the postage meter housing 20 such that all of the components of the postal-lock mechanism 21 rotate in unison when the cover 25 is rotated relative to the housing 20 and the postage meter chassis. In FIG. 7, which shows a bottom view of the postal-lock of the embodiment shown in FIG. 3, the Roman numerals I, II and III indicate the angular positions of the postal-lock as referenced by the angular positions of the line 43 defined by, and extending colinearly with, the central slot 31*c* of the base plate. It should be remembered that the direction of rotation for the cover 25, when viewed from the top of the postal-lock as in FIG. 1B, is opposite to the direction of rotation shown in FIG. 7.

Figure 2A:
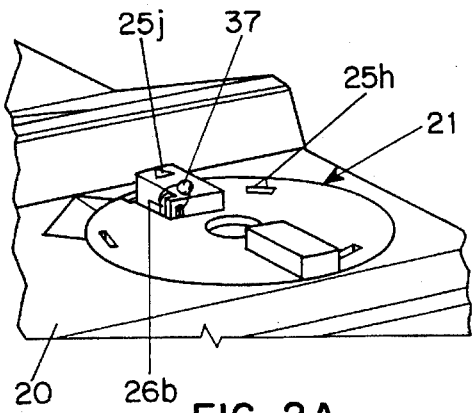
FIG. 2A is a fragmentary perspective view of the postage meter of FIGS. 1A and 1B and shows the postal-lock mechanism and lead seal and at a first angular, locked position relative to the meter housing.

When the postage meter is in a normal operating mode, the angular position of the postal-lock 21 relative to the housing 20 is as shown in FIG. 2A. This position of the postal-lock 21 corresponds to the position indicated by Roman numeral I in FIG. 7. As can be seen in FIG. 2A, during the normal operating mode of the postage meter, the sliding plate 26 and the cover 25 are tightly tied together by the wire of the lead seal 37 placed through the central openings of the arched projections 25*f* and 26*b* of the cover 25 and sliding plate 26.

Figure 2B:
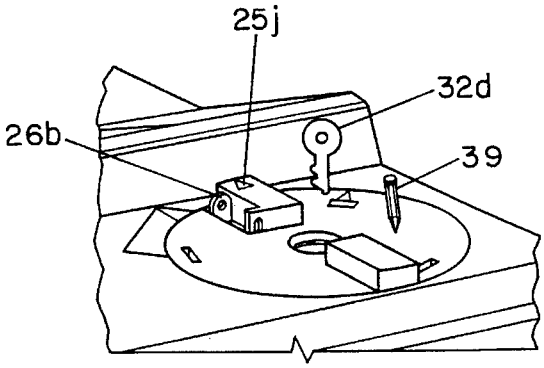
FIG. 2B is a fragmentary perspective view of the postage meter of FIGS. 1A and 1B and shows the postal-lock mechanism with the lade seal removed and at the first angular position, along with a key and a pointed probe used with the mechanism.
Figure 2C:
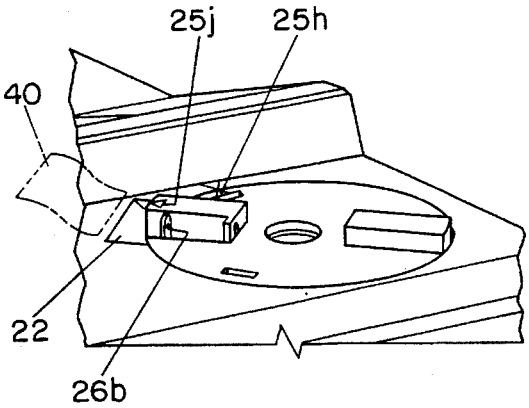
FIG. 2C is a fragmentary perspective view of the postage meter of FIGS. 1A and 1B and shows the postal-lock mechanism at a second angular position relative to the meter housing allowing access to the postage meter to add postage.

In order to "access" the postage meter to add additional postage, one must first cut the wire of the lead seal 37 and slide the arched projection 26*b* to the radial edge of the cover plate 25, as shown in FIG. 2B. If at the time of resetting the meter, the lead seal 37 has been previously broken, this indicates tampering of the postal-lock mechanism. When the arched projection 26*b* is positioned at the radial edge of the cover plate 25, the apertures 25*a*, 26*a* and 27*a* of the cover plate 25, the sliding plate 26 and the membrane support plate 27, respectively, are aligned. A frangible membrane 40, usually a paper, previously placed between the sliding plate 26 and the membrane support plate 27 and covering the central chamber 28*f* of the inner lock body 28, shown in FIG. 10A, is punctured with the probe 39 as shown in FIG. 7A. If it is noted that the frangible membrane 40 has been previously punctured, this indicates tampering. Pressing down on the bottom 28*g* of the central chamber 28*f* of the inner lock body 28 with the probe, as shown in FIG. 6A moves the inner lock body 28 and the base plate 31 downward to permit movement of the cams 31*a* of the base plate 31 over a first two of the ratchet-like projections 35 located on the bottom surface 36*b* of the cup-shaped receptacle 36, best seen in FIG. 5. The cover 25 of the postal-lock mechanism can then be turned to position II, as shown in FIGS. 2C and 7. At position II, one of the cams 31*a* of the base plate 31 contacts and depresses a limit-switch arm 38*a* of a limit switch 38 shown in FIG. 10, and the postage meter is now in the "post office" mode which allows additional postage to be added electronically to the meter, usually via keyboard. At this point, an authorized person inserts a probe through the slots 25*c* and 26*c* of the cover 25 and sliding plate 26, shown in FIG. 3, and slides the punctured frangible membrane out of the postal-lock mechanism via an access opening 22 of the housing 20 shown in FIGS. 1B and 2. To indicate proper angular positioning of the postal-lock mechanism relative to the housing, the postal-lock mechanism 21 has two position arrows 25*j* and 25*h* to be aligned with a reference arrow 20*b* on the lug 25*c*, all of which arrows are shown best in FIGS. 1B and 2.

Although the foregoing functional description referenced the use of the embodiment of the postal-lock mechanism shown in FIG. 3 with a wire/lead seal combination 37 and a frangible membrane 40, it should be readily apparent that the embodiment of FIG. 3 may be used in conjunction with only the wire/lead seal combination 37 or only the frangible membrane 40. If the embodiment of FIG. 3 is to be used in conjunction with only the frangible membrane 40, then the sliding plate 26 may be omitted from the postal-lock mechanism.

Figure 2D:
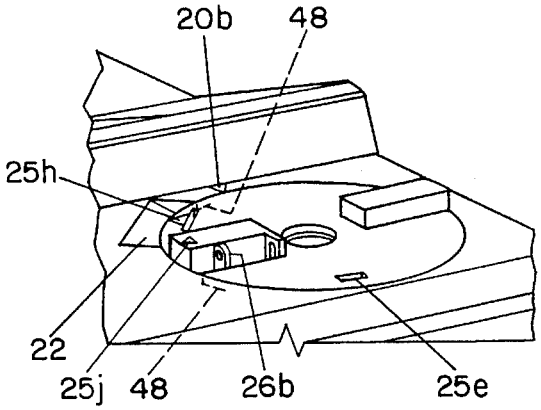
FIG. 2D is a fragmentary perspective view of the postage meter of FIGS. 1A and 1B and shows the postal-lock mechanism at a third angular position relative to the meter housing unlocking the meter housing from the meter chassis to permit access to the interior components of the meter.
Figure 11B:
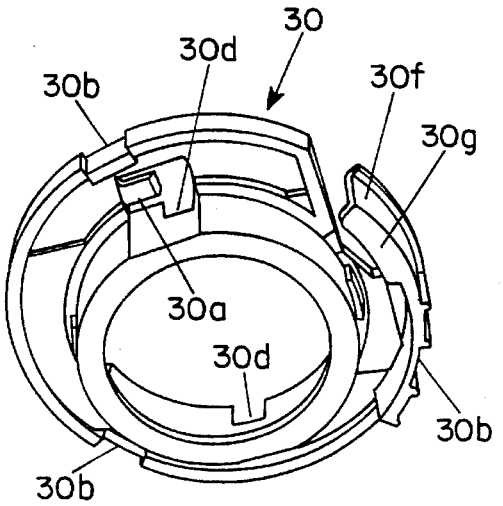
Figure 12A:
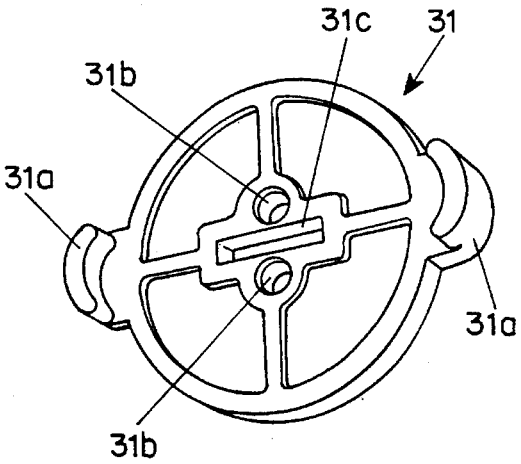
FIG. 12A and 12B are perspective views of a base plate of the postal-lock mechanism of the present invention, showing, respectively, the top and bottom of the base plate.
Figure 12B:
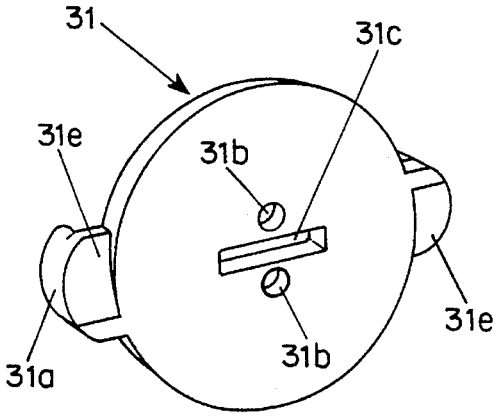

If the internal components of the postage meter have to be accessed for servicing, postal-lock is rotated to position III, as shown in FIGS. 2D and 7. At this position, the portion 30*f* of the outer lock body 30, shown best in FIGS. 5 and 11B, is disengaged from the chassis portion 24, and the postage meter housing 20 and the postal-lock mechanism 21 may be removed from the chassis by a pull-and-lift movement. Closing and locking the meter can again be accomplished as described above. As a result of the arrangement according to this invention, no independent locking system for securing the housing to the chassis is required. Furthermore, one can readily verify from the angular position of the cover 25 whether or not the meter housing is locked to the chassis.

The sequence of postal-lock rotations required for locking the postage meter are described in reference to FIGS. 2A–2D. FIG. 2D shows the postal-lock position corresponding to position III. One should remember that position III is reached only for service access. From position III, the postal-lock is rotated to position II, shown in FIGS. 2C and 7. Cam surfaces 31*e* n the cams 31*a* ride on cam surfaces of the pair of ratchet-like projections 35, moving the base plate 31 axially against the bias of the helical spring 29 until position II is reached. At position II the cams 31, having ridden over the ratchet-like projections, snap into place. For the embodiment of the present invention adapted to be used with a lead seal and a frangible membrane, at position II a frangible membrane 40, such as a paper, is inserted into the postal-lock mechanism 21 via an access opening 22 in the meter housing 20 shown in FIG. 2C. As can be understood from FIGS. 2C, 3 and 9B viewed in combination, the frangible membrane 40 is guided into position between the sliding plate 26 and the membrane support plate 27 by ridges 26d on the bottom surface of the sliding plate 26 shown in FIG. 9B. Finally, the postal-lock is rotated to position I, as shown in FIG. 2B. The base plate cams 31 a ride over the cam surfaces of the next ratchet-like projections until, at position I, the cams snap into place, locked against return movement by the ratchet-like projections. The arched projection 26*b* of the sliding plate 26 is then secured to the arched projection 25*b* of the cover plate 25 by means of the lead seal 37, as indicated in FIG. 2A.

KEY AND LOCK EMBODIMENT OF FIG. 13

Figure 13:
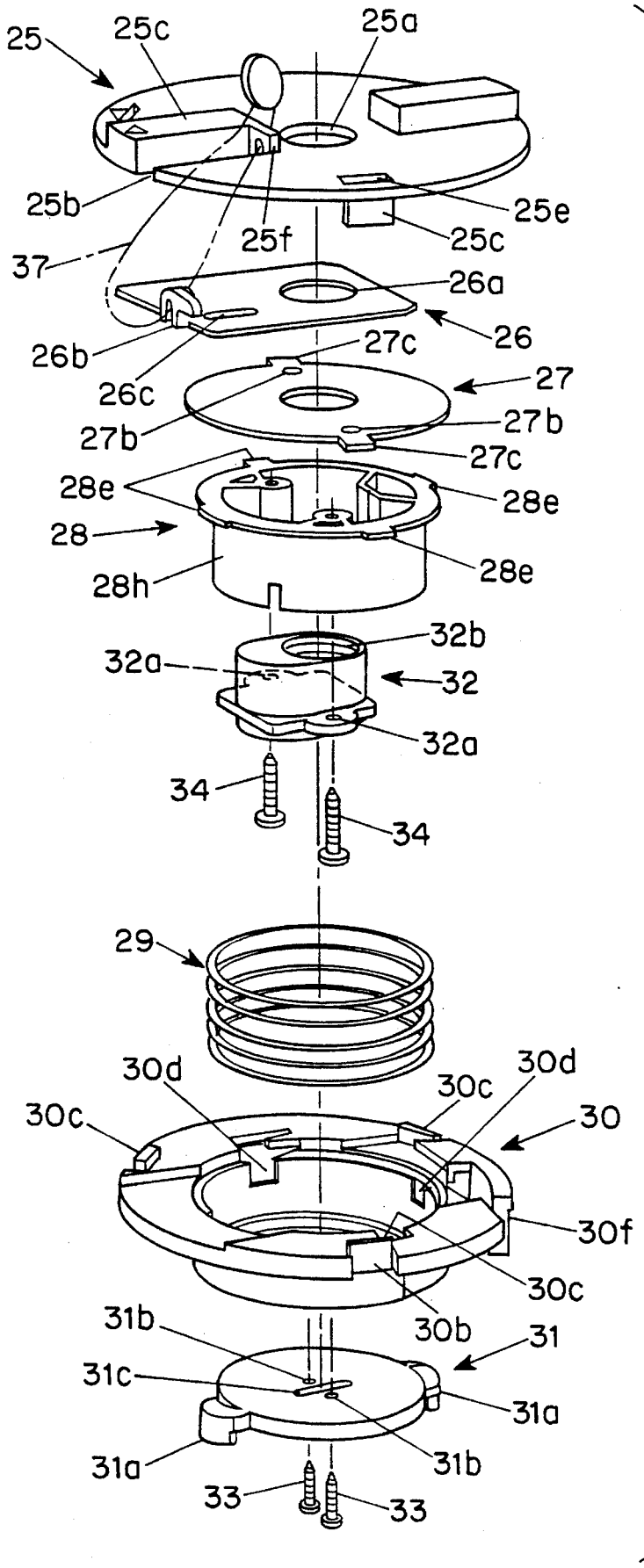
FIG. 13 is an exploded view of the cylinder-like postal-lock mechanism according to another embodiment of the present invention.

The embodiment shown in exploded view in FIG. 13 is used preferably with a key lock, and if desired or necessary, a lead seal. Except as described below, component elements and assembly of the embodiment shown in FIG. 13 are identical to those of the embodiment shown in FIG. 3 and bear like reference numerals. In contrast to the embodiment shown in FIG. 3, the embodiment shown in FIG. 13 includes the key lock 32 positioned within an alternative inner lock body 28', which is shown in isolation in FIGS. 14A and 14B. The inner lock body 28' differs from the inner lock body 28 of FIGS. 10A and 10B by having the central portion defining the central chamber 28*f* broken away to accommodate the key lock 32.

Figure 14A:
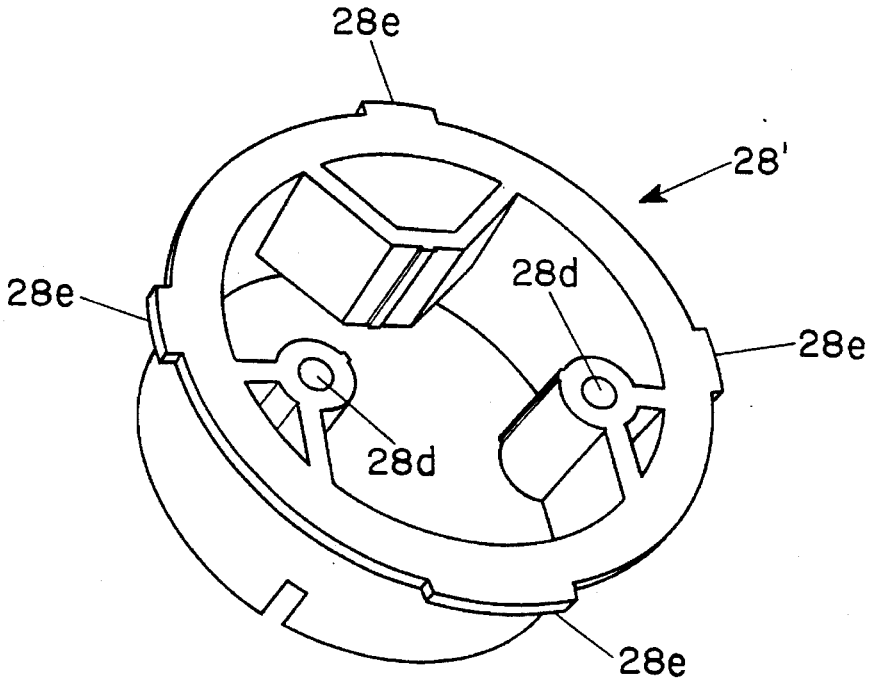
FIG. 14A and 14B are perspective views of an inner lock body of the postal-lock mechanism according to the embodiment of the present invention shown in FIG. 13, showing, respectively, the top and bottom of the inner lock body.
Figure 14B:
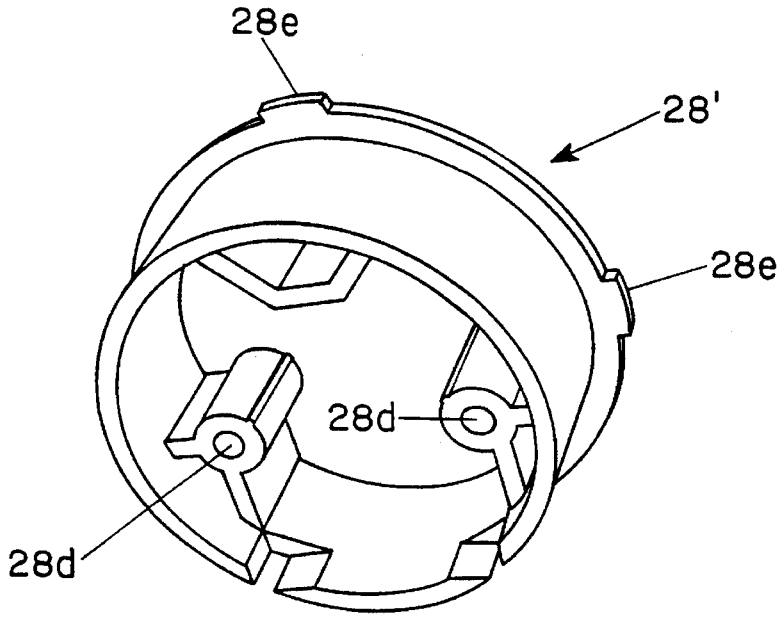
Figure 16:
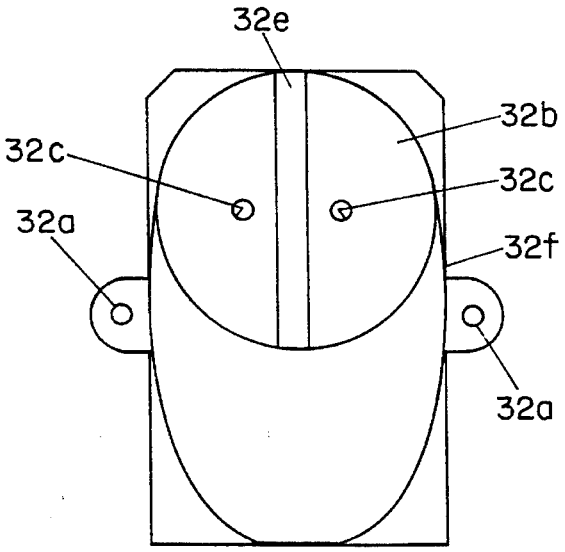
FIG. 16 is a bottom plan view of the key lock used as a component of the embodiment of the present invention shown in FIG. 13.

The inner lock body 28' of the embodiment shown in FIG. 13 does not have the two central screw-receiving holes 28*c* found in the inner lock body 28 of the embodiment shown in FIG. 3. The key lock 32 is secured to the inner lock body 28' by means of screws 34 which pass through holes 32*a* of the key lock 32 (FIG. 13) and are threaded into holes 28*d* (FIGS. 14A and 14B). The base plate 31 is secured to the key lock 32 by means of a pair of the screws 33 which pass through the apertures 31*b* of the base plate 31 and are threaded into receiving the holes 32*c* of a key lock cylinder 32b shown best in FIG. 16 The inner lock body 28', the key lock 32 and the base plate 31, which are all connected together, have a limited range of axial movement relative to the outer lock body 30 against the action of the compression spring 29, which is contained in the outer lock body 30 and coaxially surrounds the outer cylindrical surface of the inner lock body 28'. The key lock cylinder is rotatable with respect to the body 32*f* of the lock upon insertion of the correct key.

The procedure for mounting the postal-lock mechanism of the embodiment shown in FIG. 13 in the housing 20 is essentially same as for the embodiment shown in FIG. 3, with the exception that the base plate 31 is secured via screws 33 to the key lock cylinder 32*b* at a position 90° removed from its position in the embodiment of FIG. 3.

FUNCTIONAL DESCRIPTION OF FIG. 13 EMBODIMENT

Like the FIG. 3 embodiment, the embodiment of FIG. 13 is mounted in the postage meter housing 20 such that all components of the postal-lock mechanism 21 rotate in unison when the cover 25 is rotated. Furthermore, the base plate 31 and the key lock cylinder 32*b* rotate relative to the rest of the postal-lock mechanism 21 when the key lock cylinder 32*b* is turned with a key.

Figure 15:
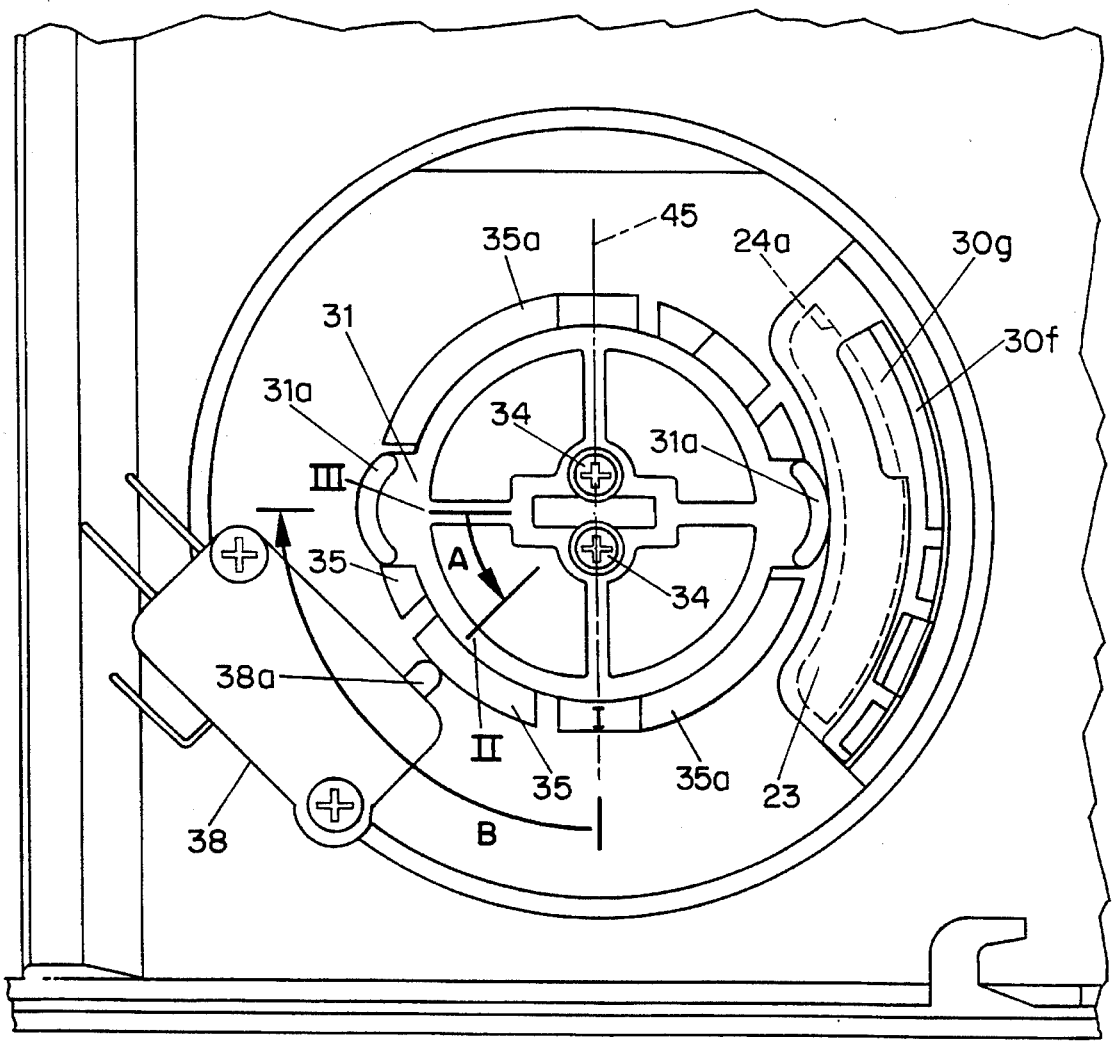
FIG. 15, a fragmentary bottom view of the postal-lock mechanism according to the embodiment of FIG. 13, and shows the relative angular movement of the entire postal-lock mechanism as well as the movement of its selected component parts.

In FIG. 15, the Roman numerals I, II and III indicate the angular positions of the FIG. 13 embodiment as referenced by the angular positions of the line 45 extending between the two screws 34. For a postage meter incorporating the FIG. 13 embodiment of the postal-lock mechanism, when the meter is in a normal operating mode, the angular position of the postal-lock 21 relative to the housing 20 is as shown in FIG. 2A. This position of the postal-lock 21 corresponds to the position indicated by Roman numeral I in FIG. 15. The postal-lock mechanism is locked in this angular position by the side-by-side abutting surfaces of the cam protrusions 31*a* and a pair of projections 35*a*. The postal-lock mechanism is thus-locked even when the lock is pushed downward against the urging of the helical spring because the pair of projections 35*a* extend farther from the bottom surface 36*b* of the cup-shaped receptacle 36 than do the ratchet-like projections 35 and the postal-lock mechanism is at the limit of its angular movement in the counter clockwise direction of FIG. 2A, by virtue of engaging projections 48 (indicated generally in FIG. 2D) or other suitable stops.

To "access" the postage meter having the postal-lock mechanism of FIG. 13 to add additional postage, one must first cut the wire of the lead seal 37, indicated in FIG. 2A, and then slide the arched projection 26*b* towards the outer edge of the cover 25, as in FIG. 2B. Again, if the lead seal 37 has been broken, this indicates tampering. When the arched projection 26*b* is at the outer edge of the cover 25, the apertures 25*a*, 26*a* and 27*a* of the cover 25, sliding plate 26 and membrane support plate 27 align with the key lock cylinder 32*b*.

After positioning the arched projection 26*b* at the outer edge of the cover 25, a key 32*d*, shown in FIG. 2B, is inserted into a key slot 32*e* in the key lock cylinder 32*b*. While pressing down on the key lock cylinder 32*b* with the key 32*d* to move the key lock cylinder 32*b* and the base plate 31 downward and disengage the cams 31*a* of the base plate 31 from the ratchet like projections 35 on the bottom surface 36*b* of the cup-shaped receptacle 36, shown in FIG. 5, the key lock cylinder 32*b* and the base plate 31 are rotated 45° relative to the rest of the postal-lock mechanism. This moves the base plate 31 from position III to position II, the angle and the direction of rotation being shown by the arrow marked "A" in FIG. 15. At position II, one of the cams 31*a* contacts and depresses the limit-switch arm 38a of the limit switch 38 shown in FIG. 15, and the postage meter is now in the "post office" mode. That allows additional postage to be added electronically to the meter, usually via the keyboard. At this point, the cover 25 of the postal-lock mechanism will still be in the angular position shown in FIG. 2B.

Although the foregoing functional description references the use of the embodiment of the postal-lock shown in FIG. 13 with a lead seal and a key lock, it should be readily apparent that this embodiment may be used in conjunction with only the key lock 32. If it is to be used in conjunction with only the key lock 32, then the sliding plate 26 may be omitted from the postal-lock mechanism.

If the internal components of the postage meter have to be accessed for servicing, pressing down upon the inserted key, the postal-lock mechanism is rotated from the position shown in FIGS. 2A and 2B to the position shown in FIG. 2D, the key and lock cylinder remaining stationary. The outer lock body 30 has now been moved 90° to remove the projection 30*f* from the chassis projection 24*a* permitting removal of the housing from the chassis. Although no key is shown in FIGS. 2C and 2D, in the FIG. 13 embodiment it should be understood that, to effect unlocking and opening of the meter, the key 32*d* must be inserted in the key lock cylinder 32*b*.

The sequence of postal-lock rotations required for locking the postage meter incorporating the embodiment of the postal-lock shown in FIG. 13 are illustrated with FIGS. 2A–2D. FIG. 2D shows the postal-lock position corresponding to opening of the meter as described. One should remember that position III is reached only for service access. Returning the postage meter to its locked, operative condition, the postal-lock mechanism 21 is rotated to position II, shown in FIGS. 2C and 8, then to the position shown in FIG. 2B. The key 32*d*, is then rotated counter-clockwise to engage the cams 31*a* of the base plate 31 with the projections 35*a* on the bottom surface 36*b* of the cup-shaped receptacle 36 in the housing. Finally, the arched projection 26*b* of the sliding plate 26 is tied tightly to the arched projection 25*f* of the cover plate 25 by means of the lead seal 37, as shown in FIG. 2A.

As can be understood from the foregoing description, the postal-lock mechanism of the present invention enables a postage meter to simultaneously satisfy the different postage meter security requirements of various countries. In addition, the postal-lock mechanism of the present invention simplifies the overall construction of postage meters by integrating the locking mechanism securing the meter housing to the meter chassis as part of the postal-lock mechanism. Furthermore, one can readily verify from the angular position of the cover plate 25 relative to the meter housing whether or not the meter housing is locked to the chassis.

While the foregoing description illustrates the preferred embodiments of the present invention, other variations and modifications will be obvious to those skilled in the art. For example, the preferred embodiments may be modified to be used in conjunction with a key lock and a frangible membrane, or in conjunction with a key lock, a lead seal, and a frangible membrane. Furthermore, while the preferred embodiments have been explained in conjunction with an electronic postage meter, the postal-lock mechanism of the present invention may be used in conjunction with a mechanical postage meter. These and other alternatives may be employed without departure from the spirit and scope of the invention as intended to be set forth in the appended claims.

I claim:

1. A postal-lock mechanism adapted to be rotatably mounted in a housing of a postage meter for rotation between a first position securing the meter against resetting, and a second position permitting access to the postage meter for resetting, including an external member located at the exterior of the postage meter housing and rotatable with respect to the postage-meter housing;

an internal member located at the interior of the postage meter housing and manually rotatable with respect to the postage-meter housing;

means connecting said internal member to said external member through an opening in the postage-meter housing;

at least one element of the postal-lock mechanism releasably engaging a stationary part of the postage meter in rotation preventing relation, whereby access to the meter for resetting is prevented until at least one element is released from engagement with the stationary part of the postage meter; and at least one member of the postal-lock mechanism being engageable with a postage meter chassis-connected part to lock the housing to the chassis in said first and second positions of the postal-lock mechanism, said postal-lock mechanism being rotatable to a third position to withdraw the at least one member from the chassis-connected part to permit removal of the housing from the chassis.

2. A postal-lock mechanism according to claim 1, wherein the postal-lock mechanism is received in a cup shaped receptacle in the postage meter, the bottom of said receptacle being said stationary part, the receptacle having an opening through a side wall thereof located to receive the chassis-connected part, the means connecting said internal member to said external member including an outer lock member having a projecting portion rotatable with the postal-lock mechanism to grasp the chassis-connected part, thereby to secure the housing to the chassis.

3. A postal-lock mechanism adapted to be rotatably mounted in a housing of a postage meter for rotation between a first position securing the meter against resetting, and a second position permitting access to the postage meter for resetting, including an external member located at the exterior of the postage meter housing and rotatable with respect to the postage-meter housing;

an internal member rotated at the interior of the postage meter housing and manually rotatable with respect to the postage-meter housing;

means connecting said internal member to said external member through an opening in the postage-meter housing;

at least one element of the postal-lock mechanism releasably engaging a stationary part of the postage meter in rotation preventing relation, whereby access to the meter for resetting is prevented until at least one element is released from engagement with the stationary part of the postage meter;

said means interconnecting said internal member to said external member includes means for releasing the at least one element from engagement with the stationary part, and said postal-lock mechanism further comprising means for selectively preventing and allowing access to the interior of the postal-lock mechanism to permit operation of the means for releasing.

4. A postal-lock mechanism according to claim 3, wherein the external member is a cover having an opening to the means for releasing;

the means for selectively preventing and allowing access to the interior of the postal-lock mechanism comprising means for selectively sealing and unsealing the opening of the cover.

5. A postal-lock mechanism according to claim 4, wherein the means for releasing the at least one element from engagement with the stationary part comprises an inner lock member mounted between the external and internal members, connected to the internal member and mounted for limited axial movement to move the internal member axially out of rotation inhibiting engagement with the stationary part.

6. A postal-lock mechanism according to claim 5, wherein the stationary part and the at least one element have a cooperating series of ratchet-like projections and means engaged thereby, said limited axial movement of the inner lock member freeing the means engaging from the ratchet-like projections to permit rotation of the postal-lock mechanism.

7. A postal-lock mechanism according to claim 5, wherein said means for selectively sealing and unsealing the said cover opening comprises a first plate positioned below the cover and slidably engaging the cover, said first plate having an opening adapted to slide with the plate into and out of alignment with the opening of the cover to permit access to the axially movable inner lock member to release the postal-lock mechanism for rotation.

8. A postal-lock mechanism according to claim 4, wherein said means for selectively sealing and unsealing said cover opening comprises a first plate positioned below the cover and slidably engaging the cover, said first plate having an opening adapted to slide into and out of alignment with the opening of the cover.

9. A postal-lock mechanism according to claim 8, wherein:

the cover and first plate include means enabling the cover and first plate to be sealed together with the opening of the first plate out of alignment with the opening of the cover.

10. A postal-lock mechanism according to claim 9, wherein the means enabling the cover and first plate to be sealed together are aligned projections on the first plate and the cover, each adapted to receive a sealing means, said cover including a slot through which the projection of the first plate protrudes for sliding movement to and away from the projection on the cover.

11. A postal-lock mechanism according to claim 10, wherein the projections include aligned openings to receive a wire and lead seal.

12. A postal-lock mechanism according to claim 4, wherein said means for selectively sealing and unsealing the cover opening further comprises means for receiving a frangible membrane below the cover in sealing relation to the opening of the cover.

13. A postal-lock mechanism according to claim 12, wherein said means for selectively sealing and unsealing said cover opening comprises a first plate positioned below the cover and slidably engaging the cover, said first plate having an opening adapted to slide into and out of alignment with the opening of the cover.

14. A postal-lock mechanism according to claim 13, wherein said means for selectively sealing and unsealing the cover opening further comprises means for receiving a frangible membrane between the cover and the first plate in sealing relation to the opening of the cover.

15. A postal-lock mechanism according to claim 14, wherein the cover and first plate include means enabling the cover and first plate to be sealed together with the opening of the first plate out of alignment with the opening of the cover.

16. A postal-lock mechanism according to claim 3, said means connecting said internal member to said external member further comprising a key lock and connected to said external member, said key lock having a rotatable cylinder connected to the internal member to be rotated with the internal member upon insertion of a key.

17. A postal-lock mechanism according to claim 16, wherein said means for selectively sealing and unsealing the cover opening comprises a first plate positioned between the cover and key lock, said first plate having an opening adapted to be aligned with the cover opening to allow access to the key lock.

18. A postal-lock mechanism according to claim 16, wherein the postal-lock mechanism has a limit of rotational movement in one direction and the internal member and stationary part have abutting surfaces limiting rotational movement of the internal member in the opposite direction, whereby said key lock is operative to lock the postal-lock mechanism against rotational movement at its limit of rotational movement in the one direction by rotation of the cylinder and internal member to said limit of rotational movement in the opposite direction and locking of the key lock to lock together the external and internal members.

19. A postal-lock mechanism adapted to be rotatably mounted in a postage meter housing for preventing tampering of a postage meter being of a type including a chassis and a means for activating the postage meter to allow the addition of postage, the postal-lock mechanism comprising:

a disc-shaped cover plate having a protrusion extending perpendicular to a first surface thereof, the protrusion having an aperture, the cover plate having a central opening and an elongated slot extending generally radially inwardly from periphery of the cover plate;

a sliding plate having a protrusion extending perpendicular to a first surface thereof, the sliding plate positioned below the disc-shaped cover plate, the sliding plate's protrusion being received in the elongated slot of the cover, the sliding plate having an elongated opening and a central opening, the sliding plate's protrusion having an aperture such that the sliding plate's protrusion is adapted to be tied to the cover plate's protrusion, the central opening aligning with the central opening of the cover plate when the sliding plate is in a first predetermined linear position relative to the cover plate and the elongated opening aligning with the elongated slot of the cover plate when the sliding plate is in a second predetermined linear position relative to the cover plate;

a membrane support plate positioned below the sliding plate, the membrane support plate having a central opening aligned with the central opening of the cover plate, the membrane support plate adapted to support a frangible membrane inserted between the sliding plate and the membrane support plate;

an outer lock body positioned below the membrane support plate and connected to the membrane support plate and the cover plate;

an inner lock body positioned inside the outer lock body and below the membrane support plate, the inner lock body being adapted to rotate with the outer lock body and the cover plate;

means for movably supporting the inner lock body, the support means positioned inside the outer lock body and coaxially surrounding the outer surface of the inner lock body, resilient support means movably supporting the inner lock body such that the inner lock body has a limited range of axial movement relative to the outer lock body; and a base plate having a protrusion at its radial edge, positioned below the outer lock body and securely connected to the inner lock body such that the inner lock body and the base plate in unison have a limited range of axial movement relative to the outer lock body, the base plate protrusion normally engaging projections on the interior surface of the postage meter housing, the base plate protrusion adapted to be disengaged from the interior surface projections of the postage meter housing upon exertion of downward force on the inner lock body and to activate a switch in the postage meter upon rotation to a first predetermined angular position in relation to the postage meter chassis;

whereby said activation of the postage meter switch enables addition of postage to the postage meter, and wherein the postal-lock mechanism is able to accommodate a wire and lead seal at the protrusions of the sliding plate and the cover plate, and a frangible membrane at the membrane support plate.

20. A postal-lock mechanism according to claim 19, wherein the outer lock body is adapted to engage a postage meter chassis-connected part when the postal-lock mechanism is at the first and a second predetermined angular positions, and the outer lock body is adapted to be disengaged from the postage meter chassis-connected part when the postal-lock mechanism is at a third predetermined angular position in relation to the chassis, said postal-lock mechanism locking the postage meter housing to the postage meter chassis when said postal-lock mechanism is at said first and second predetermined angular positions, and the postage meter housing being disengaged from the postage meter chassis when the postal-lock mechanism is at the third predetermined angular position.

21. A postal-lock mechanism according to claim 20, wherein the inner lock body further comprises an open central chamber against which an external force can be applied to move the inner lock body and the base plate axially in relation to the outer lock body.

22. A postal-lock mechanism according to claim 21, wherein the resilient means for movably supporting the inner lock body comprises a spring.

23. A postal-lock mechanism according to claim 19, further comprising:

a key lock positioned inside the inner lock body, the key lock being connected to the inner lock body, and the key lock having a rotatable central cylinder connected to the base plate and adapted to be rotated with the base plate;

wherein the postal-lock mechanism is able to accommodate a key at the key lock for rotating the central cylinder in unison with the base plate.

* * * * *

UNITED STATES PATENT AND TRADEMARK OFFICE

CERTIFICATE OF CORRECTION

PATENT NO. : 5,496,990

DATED : March 5, 1996

INVENTOR(S) : Christian Gillieron

It is certified that error appears in the above-indentified patent and that said Letters Patent is hereby corrected as shown below:

On the title page: Item [56] "11/1987" should read --1/1987--.

Col. 5, line 55, "surface 2" should read --surface 28h--.

Col. 14, line 58, "claim 20" should read --claim 19--.

Signed and Sealed this

Seventh Day of January, 1997

Bruce Lehman

*Attest:*

BRUCE LEHMAN

*Attesting Officer*

*Commissioner of Patents and Trademarks*